US010274884B2

(12) United States Patent
Okanishi

(10) Patent No.: US 10,274,884 B2
(45) Date of Patent: Apr. 30, 2019

(54) IMAGE FORMING APPARATUS AND SYSTEM THAT DETERMINE TYPE OF RECORDING MATERIAL BASED ON DETECTING RESULTS OBTAINED FROM MULTIPLE IMAGE FORMING APPARATUSES

(71) Applicant: CANON KABUSHIKI KAISHA, Tokyo (JP)

(72) Inventor: Tadashi Okanishi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/809,044

(22) Filed: Nov. 10, 2017

(65) Prior Publication Data

US 2018/0150012 A1 May 31, 2018

(30) Foreign Application Priority Data

Nov. 28, 2016 (JP) ..... 2016-230563

(51) Int. Cl.
*G03G 15/00* (2006.01)
*G03G 15/043* (2006.01)

(52) U.S. Cl.
CPC ..... *G03G 15/5062* (2013.01); *G03G 15/043* (2013.01); *G03G 15/5029* (2013.01); *G03G 15/6591* (2013.01)

(58) Field of Classification Search
None
See application file for complete search history.

(56) References Cited

U.S. PATENT DOCUMENTS 5,774,146 A * 6/1998 Mizutani ..... B41J 2/21 347/12
6,647,222 B1 * 11/2003 Digby ..... G03G 15/502 399/24
9,785,103 B2 * 10/2017 Yasukaga ..... H04N 1/00278
2007/0204045 A1 * 8/2007 Shima ..... H04N 1/00233 709/226
2009/0003857 A1 * 1/2009 Kuramochi ..... B65H 7/02 399/45
2016/0044195 A1 * 2/2016 Murrell ..... H04N 1/00724 358/1.1

FOREIGN PATENT DOCUMENTS

JP 2004109167 A 4/2004
JP 2007055814 A 3/2007
JP 2015176399 A 10/2015
JP 2016194659 A 11/2016

* cited by examiner

*Primary Examiner* — Victor Verbitsky
(74) *Attorney, Agent, or Firm* — Rossi, Kimms & McDowell LLP

(57) ABSTRACT

An image forming apparatus connected to one or more other image forming apparatuses, the image forming apparatus comprises: a detecting unit that detects a characteristic of a recording material; an obtaining unit that obtains a detection result by the detecting unit in each of the one or more other image forming apparatuses; and a determining unit that determines a type of a recording material used for image formation in the image forming apparatus based on the detection result by the detecting unit and the detection result obtained by the obtaining unit.

14 Claims, 14 Drawing Sheets

| TYPE REGION | PAPER TYPE |
|---|---|
| 1 | THIN PAPER |
| 2 | NORMAL PAPER |
| 3 | THICK PAPER |
| 4 | GLOSSY THIN PAPER |
| 5 | GLOSSY NORMAL PAPER |
| 6 | GLOSSY THICK PAPER |

| FIXING REGION | FIXING TEMPERATURE [°C] |
|---|---|
| 2-1 | 220 |
| 2-2 | 221 |
| 2-3 | 222 |
| 2-4 | 223 |
| 2-5 | 219 |
| 2-6 | 220 |
| 2-7 | 221 |
| 2-8 | 222 |
| 2-9 | 218 |
| 2-10 | 219 |
| 2-11 | 220 |
| 2-12 | 221 |

IMAGE FORMING APPARATUS AND SYSTEM THAT DETERMINE TYPE OF RECORDING MATERIAL BASED ON DETECTING RESULTS OBTAINED FROM MULTIPLE IMAGE FORMING APPARATUSES

BACKGROUND OF THE INVENTION

Field of the Invention

The present invention relates to an image forming apparatus and a system.

Description of the Related Art

A technique in which in an image forming apparatus that uses an electrophotographic method, variable control of a developing condition, a transfer condition, a conveyance condition, or a fixing condition in accordance with a type of recording material, is performed using a sensor for determining a recording material, has been proposed. There are apparatuses that provide, as a specific configuration for a sensor for determining the recording material, a light source at a position opposite a sensor for determining a print paper, and by detecting transmitted light, the thickness of the print paper is determined according to the transmitted light. Also, a method in which the surface of a recording material is captured by a CCD sensor or a CMOS sensor, and a roughness of the recording material is detected from a magnitude relation of the density thereof, and a method in which the thickness of a recording material is detected from the length of a shadow that appears at an end portion of a recording material have been proposed.

In an image forming apparatus in which a sensor for determining a recording material is mounted, as described above, productivity decreases in the case where the above described determination method is performed in relation to all recording materials. Accordingly, a method of controlling so as to confirm the result of detecting the paper type of a feeding unit in which recording materials are contained according to the result of determination of a number of sheets specified in advance, and thereafter omitting recording material determination processing has been proposed (Japanese Patent Laid-Open No. 2007-055814).

However, in the foregoing conventional image forming apparatus, because the processing to determine the recording material of the number of sheets specified in advance is necessary, there is a problem in that a productivity will necessarily decrease proportionally to that specified number of sheets.

SUMMARY OF THE INVENTION

The present invention was conceived in view of the above described problem, and confirms a recording material determination while reducing a decrease of productivity accompanying recording material determination processing in an image forming apparatus.

According to one aspect of the present invention, there is provided an image forming apparatus connected to one or more other image forming apparatuses, the image forming apparatus comprising: a detecting unit configured to detect a characteristic of a recording material; an obtaining unit configured to obtain a detection result by the detecting unit in each of the one or more other image forming apparatuses; and a determining unit configured to determine a type of a recording material used for image formation in the image forming apparatus based on the detection result by the detecting unit and the detection result obtained by the obtaining unit.

According to another aspect of the present invention, there is provided a system including a plurality of image forming apparatuses and a server that collects detection results from image forming apparatuses, wherein each of the plurality of image forming apparatuses includes: a detecting unit configured to detect a characteristic of a recording material; an obtaining unit configured to obtain a detection result by the detecting unit in each of the other image forming apparatuses; and a determining unit configured to determine a type of a recording material used for image formation in the image forming apparatus based on the detection result by the detecting unit and the detection result obtained by the obtaining unit, and the obtaining unit, via the server, obtains the detection result by the detecting unit of another image forming apparatus.

By virtue of the present invention, it becomes possible to confirm a recording material determination while reducing a decrease of productivity of an image forming apparatus when executing a recording material determination.

Further features of the present invention will become apparent from the following description of exemplary embodiments (with reference to the attached drawings).

DESCRIPTION OF THE EMBODIMENTS

<First Embodiment>

The first embodiment describes a method in which, when executing a recording material determination for a target image forming apparatus, the result of a recording material determination obtained from another image forming apparatus connected to a network is used.

[System Configuration]

Figure 1:
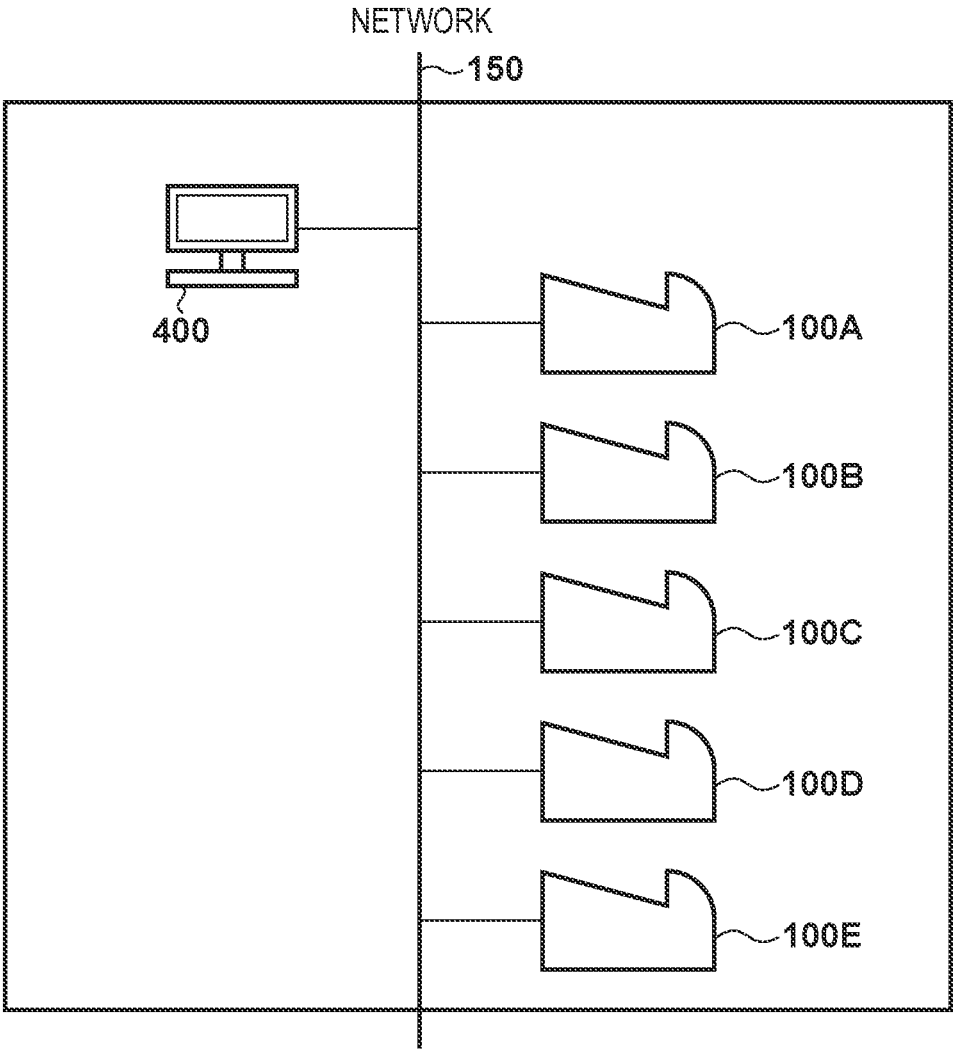
FIG. 1 is a view illustrating an example of an installation environment of an image forming apparatus according to a first embodiment.

An example of a configuration of a system that includes an image forming apparatus according to the present embodiment will be described. In the present embodiment, as illustrated in FIG. 1, in a system, a plurality of image forming apparatuses 100 (100A, 100B, 100C, 100D, and 100E) and a host computer 400 are connected via a network 150 so as to be able to communicate. An image forming instruction can be made to any of the image forming apparatuses 100 by an instruction from the host computer 400. Note that the number of image forming apparatuses 100 is not limited to that of the configuration of FIG. 1.

In the present embodiment, it is possible to share recording material determination results detected in the respective image forming apparatuses 100 with other image forming apparatuses. Note that the method of sharing the recording material determination results may be a method of sharing the results by a server or sharing the results by direct communication between the image forming apparatuses 100. The server here may be the host computer 400, and may be another external apparatus. Also, the network 150 illustrated in FIG. 1 may be an internal network, and configuration may be such that it is connected to an external network that connects between locations.

[Apparatus Configuration]

Figure 2:
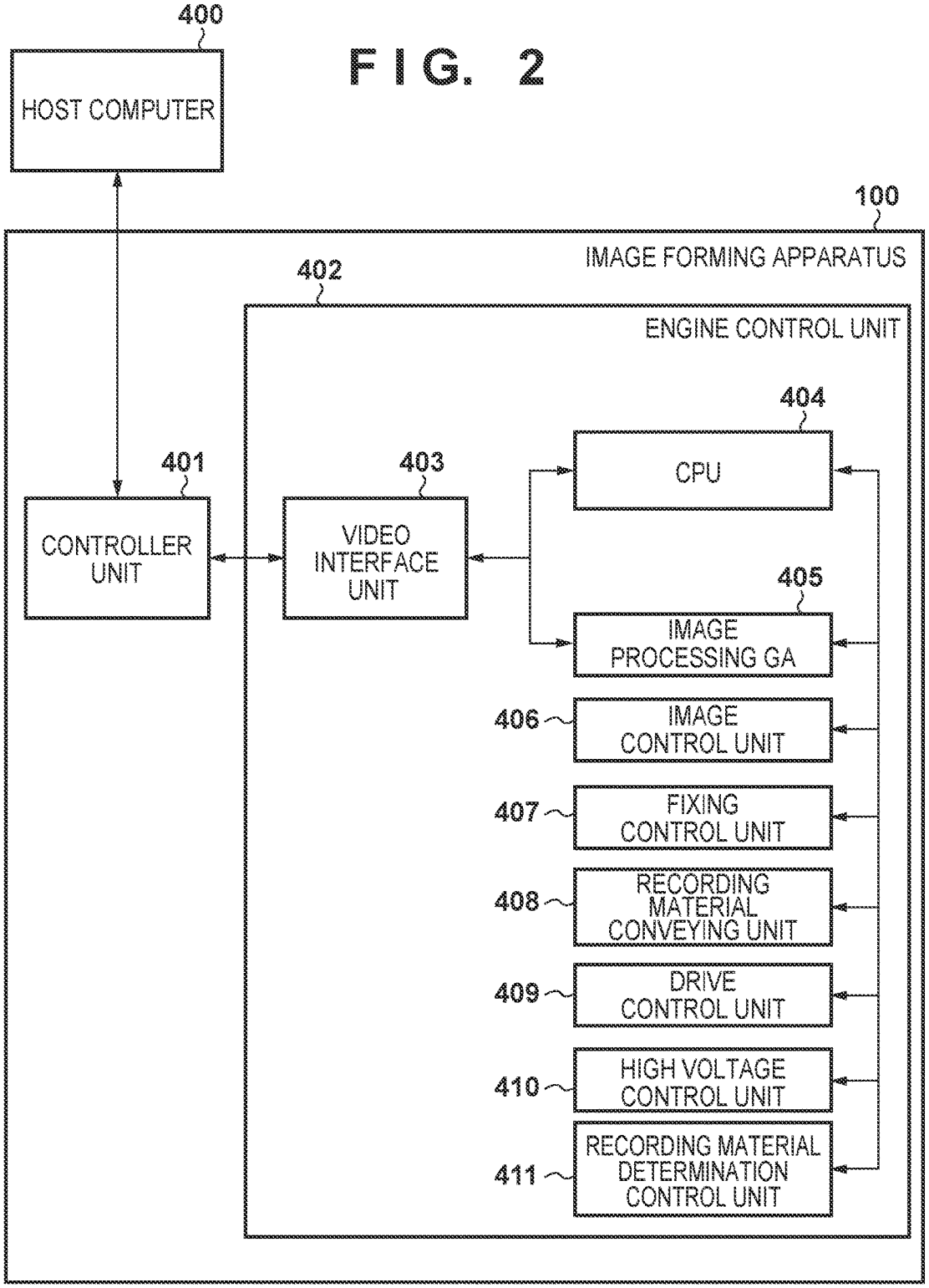
FIG. 2 is a view illustrating an example of a hardware configuration of an image forming apparatus according to the first embodiment.

FIG. 2 is a view representing an example of a hardware configuration of image forming apparatuses 100 according to the present embodiment. Note that in the present embodiment, the plurality of image forming apparatuses 100 illustrated in FIG. 1 are described as all having the same configuration, but limitation is not made to this configuration, and another configuration may be included if characteristic processing of the present invention can be executed.

The image forming apparatus 100 is configured to include a controller unit 401 and an engine control unit 402. The controller unit 401 is connected to the host computer 400 via the network 150, and it converts images transmitted from the host computer 400 into image information that the engine control unit 402 can receive.

The engine control unit 402 performs image formation of the image information received from the controller unit 401 via a video interface unit 403 on a recording material. The engine control unit 402 is configured to include a CPU (central arithmetic processing device) 404, an image processing GA 405, an image control unit 406, a fixing control unit 407, a recording material conveying unit 408, a drive control unit 409, a high voltage control unit 410, and a recording material determination control unit 411. By these units, image formation is performed. An overview of the flow of image formation is described using FIG. 3. The video interface unit 403 is an interface with the controller unit 401, and performs transmission/reception of image information and the like. The CPU 404 performs control of the engine control unit 402 as a whole. The image control unit 406, based on image information, performs output control for an image for which image formation is to be performed. The fixing control unit 407 performs control for fixing toner transferred onto a recording material. The recording material conveying unit 408 conveys a recording material on which image formation is performed. The drive control unit 409 controls driving of a motor or the like upon image formation. The high voltage control unit 410 controls voltage upon image formation. The recording material determination control unit 411 determines the type of a recording material such as paper that the image forming apparatuses 100 uses.

Figure 3:
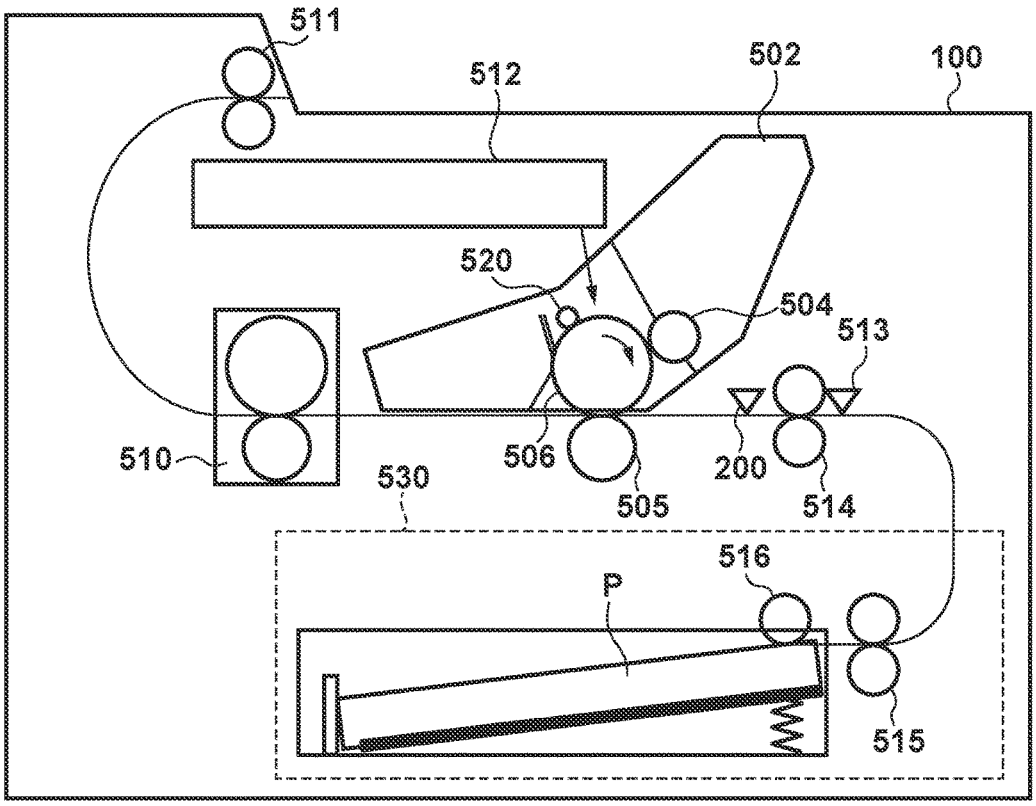
FIG. 3 is a view illustrating a schematic view of an image forming apparatus according to the first embodiment.

FIG. 3 is a schematic view of the image forming apparatus 100. A recording material P, which is a sheet, is stacked in a feeding unit 530, which is a feeding unit, and is fed one sheet at a time by a feed roller 516 at a predetermined timing. The recording material P is conveyed to a photosensitive drum 506 which is an image carrying body by a conveying roller 515 and a conveying roller 514. The timing at which the recording material P arrives is detected by a registration sensor 513 installed on the conveyance path of the recording material P. After that, if the determination of the recording material P has not yet been confirmed, the sheet is temporarily stopped when the leading edge of the sheet reaches the recording material determination sensor 200, and determination of the recording material P is performed. Details of the recording material determination according to the present invention will be described later.

The photosensitive drum 506 rotates in the direction of the arrow, and a charging bias is applied to a charging roller 520 and a developing bias to a developing roller 504 at a predetermined timing. The photosensitive drum 506 is charged uniformly by the charging roller 520. A laser beam is outputted from a laser scanner unit 512 at a predetermined timing. The laser beam outputted from the laser scanner unit 512 is irradiated onto the photosensitive drum 506, and an electrostatic latent image is formed on the photosensitive drum 506. A toner container 502 is filled with toner. Toner is supplied onto the photosensitive drum 506 by the developing roller 504 rotating, and an electrostatic latent image is visualized as a toner image. A transfer roller 505 is positioned opposite the photosensitive drum 506 sandwiching the recording material P. A transfer bias of a voltage of a different polarity to the toner is applied to the transfer roller 505 and thereby the toner image on the photosensitive drum 506 is transferred to the recording material P. The recording material P after the toner image is transferred thereto is heated and pressurized by a fixing unit 510, which is a fixing unit, and a toner image is thereby fixed. The recording material P, after the toner image is fixed thereon, is discharged to the outside of the image forming apparatus 100 by a conveying roller 511.

[Recording Material Determination Control Unit Configuration]

Figure 4:
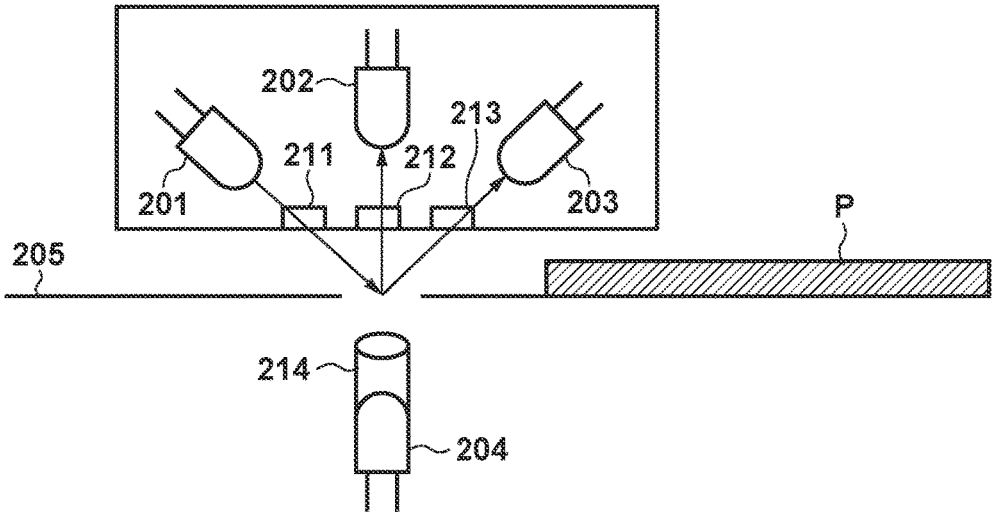
FIG. 4 is a view illustrating an example of a configuration of a recording material determination sensor according to the first embodiment.

FIG. 4 illustrates an example of a configuration of the recording material determination sensor 200 mounted in the recording material determination control unit 411. The recording material determination sensor 200 has an LED 201 that is a first irradiation unit, an LED 204 that is a second irradiation unit, a phototransistor 203 that is a first reading unit, and a phototransistor 202 that is a second reading unit.

The light whose light source is the LED 201 is irradiated onto the front surface of the recording material P on a recording material conveyance guide 205 via a slit 211. Also, the recording material conveyance guide 205 provides a window for irradiating light from the back surface side of the recording material P in the present embodiment. Reflected light from the recording material P is collected via slits 212 and 213, and received at the phototransistors 202 and 203. For the light whose light source is the LED 201, the phototransistor 202 obtains a diffused reflection output value, and the phototransistor 203 obtains a specular reflection output value. Thereby, a degree of gloss (specular reflection output/diffused reflection output) of the recording material P is detected.

The light whose light source is the LED 204 passes through a focus guide 214 for focusing the light, and is irradiated on the back surface of the recording material P. Light that the recording material P transmits is received at the phototransistor 202 via the slit 212. For light whose light source is the LED 204, the phototransistor 202 obtains a regular transmission output value. By this, a transmittance (output of the phototransistor 202) of the recording material P is detected. Note that it is assumed that that is a difference between the timing at which the degree of gloss is detected using the LED 201 and the timing at which the transmittance is detected using the LED 204, but either may be detected first. Also, the configuration for detecting the degree of gloss and the transmittance is integrated in the recording material determination sensor 200 illustrated in FIG. 4, but limitation is not made to this configuration, and configuration may be such that each sensor is comprised separately.

Figure 5:
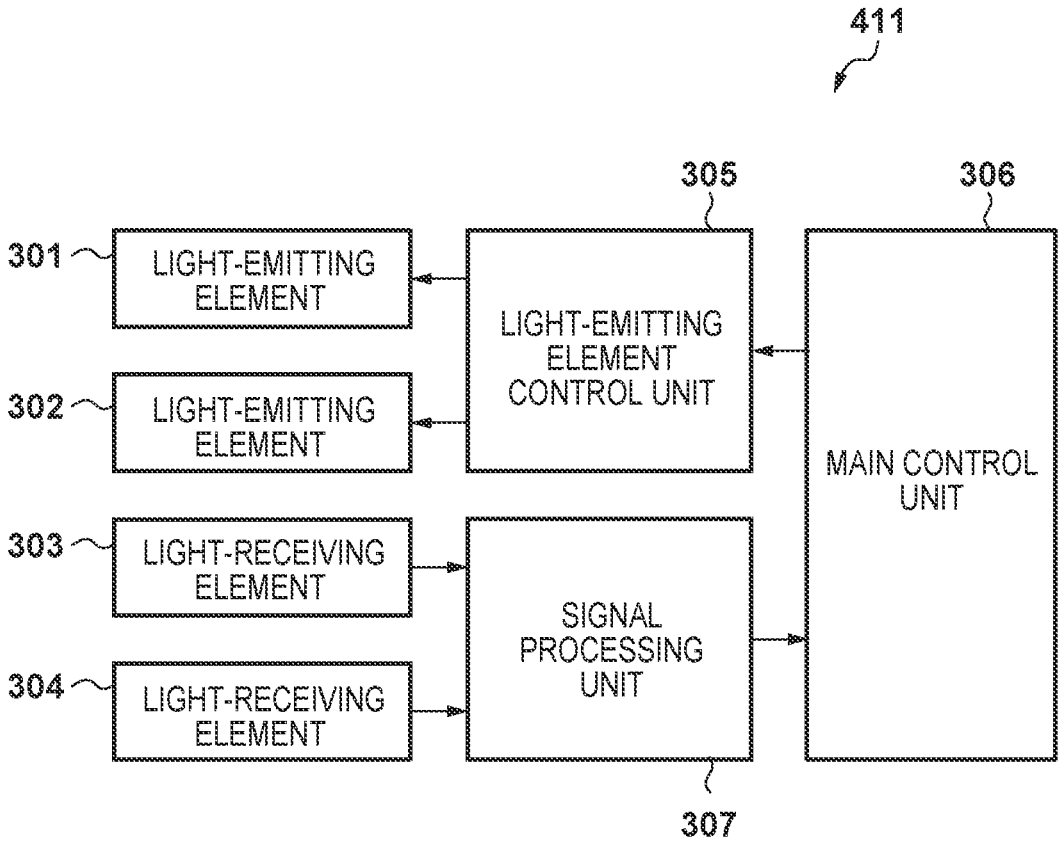
FIG. 5 is a view illustrating an example of a configuration of a recording material determination control unit according to the first embodiment.

FIG. 5 is a view illustrating an example of an internal configuration of the recording material determination control unit 411. A light-emitting element control unit 305 comprises a D/A converter (not shown), and drives a light-emitting element 301 (the LED 201) and a light-emitting element 302 (the LED 204), and a main control unit 306 controls the light-emitting element control unit 305.

A signal processing unit 307 performs an A/D conversion of output values from a light-receiving element 303 (the phototransistor 202) and a light-receiving element 304 (the phototransistor 203) at a 16 bit resolution, and calculates output values therefor. For example, calculation of the output value obtains values that indicate the degree of gloss of the recording material P (specular reflection output/diffused reflection output) and a transmittance that indicates an optical transparency (thickness) of the recording material P (output of the phototransistor 202).

Furthermore, the main control unit 306 performs a determination of the recording material P based on the degree of gloss and the transmittance of the recording material P obtained from the signal processing unit 307.

Below, the LED 201 (the light-emitting element 301) and the phototransistor 203 (the light-receiving element 304) in the recording material determination sensor 200 are described as the degree of gloss sensor. Also, the LED 204 (the light-emitting element 302) and the phototransistor 202 (the light-receiving element 303) are described as the transmittance sensor.

[Recording Material Determination Control Unit Determination Function]

Figures 6A, 6B:
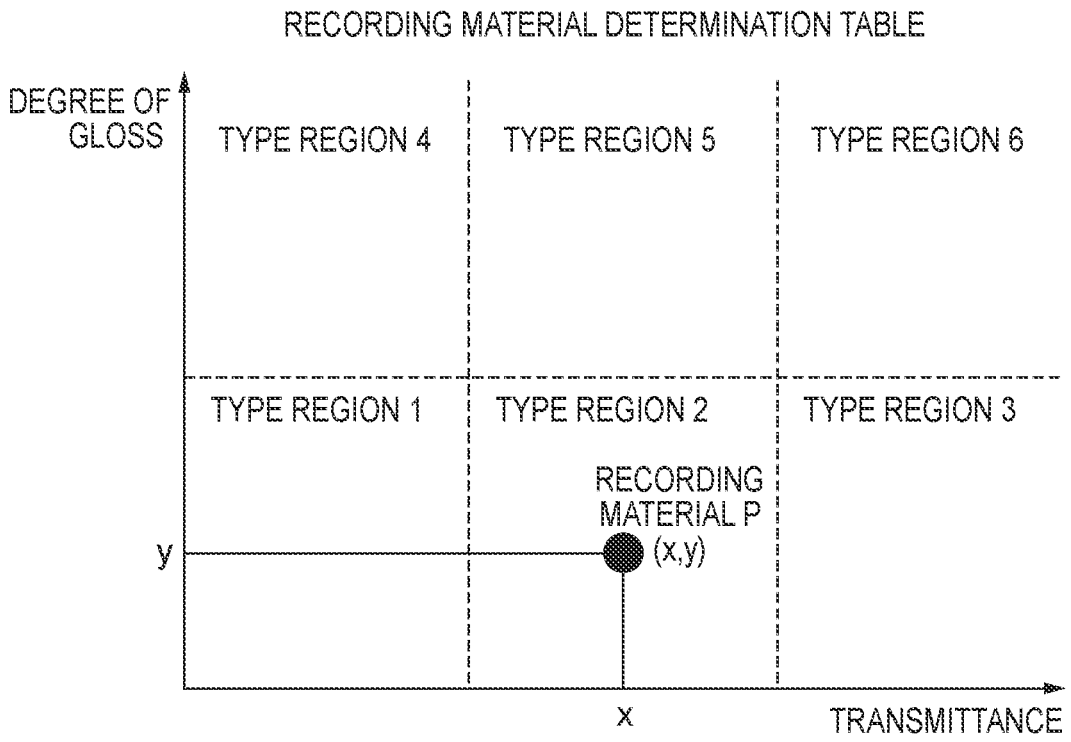
FIGS. 6A and 6B are views for describing a recording material determination table according to the first embodiment.

Using FIGS. 6A and 6B, a basic function of the recording material determination control unit 411 will be described. The method of determining the recording material is to plot coordinates on a recording material determination table, as illustrated in FIG. 6A, of the transmittance and the degree of gloss of the recording material obtained from the recording material determination control unit 411 as x and y respectively. By this, a type region to which the recording material belongs is specified. In FIG. 6A, the abscissa (x-axis) indicates transmittance and the ordinate (y-axis) indicates the degree of gloss. Furthermore, the specific type of the recording material is decided based on the paper types (types of recording materials) associated with the type regions of FIG. 6B. The coordinates indicating a range of each type region, and information of the paper type corresponding to each type region is assumed to be held in a storage unit of the image forming apparatus 100 or the like. Note that the type regions and paper types indicated in FIGS. 6A and 6B are not limited to this. For example, the size of the type regions (range corresponding to the degree of gloss and transmittance) may differ for each type of paper, and the number of regions may be increased/decreased in accordance with the number of types of recording materials that the image forming apparatus handles. Also, regarding values corresponding to a recording material that the image forming apparatus does not support, a region in which the recording material cannot be specified may be provided, and configuration may be taken such that an error is notified in the case that such a value is detected.

An environment in which the present invention can be applied will be described. In a case where one image forming apparatus among the plurality of image forming apparatuses 100 illustrated in FIG. 1 runs out of recording materials, an appropriate recording material is selected from among the number of types of recording materials stored on that floor, and that image forming apparatus is replenished. Similarly, a recording material of other image forming apparatuses installed on the same floor is selected from among the number of types of recording materials are the apparatus is replenished thereby. Specifically, the recording materials that image forming apparatuses installed on the same floor use are envisioned to be generally uniform.

Meanwhile, in the conventional technique described above, a method of confirming the type of recording material from the result of an initial determination of the plurality of locations (a plurality of sheets) in order to improve determination accuracy of a recording material determination control unit has been proposed. However, productivity decreases because of the time required for determining the recording material in an image forming operation in relation to a plurality of sheets for which the determination is performed. Accordingly, in the present embodiment, in consideration of the characteristic that uniform recording materials are used on the same floor (the same image formation environment) as previously described, the results of a recording material determination of other image forming apparatuses are used. Note that, in the present embodiment, it is assumed that a server or the respective image forming apparatuses manage information of the other image forming apparatuses located on the same floor (specifically, the other image forming apparatuses whose detection results are to be collected) in advance.

Figure 7:
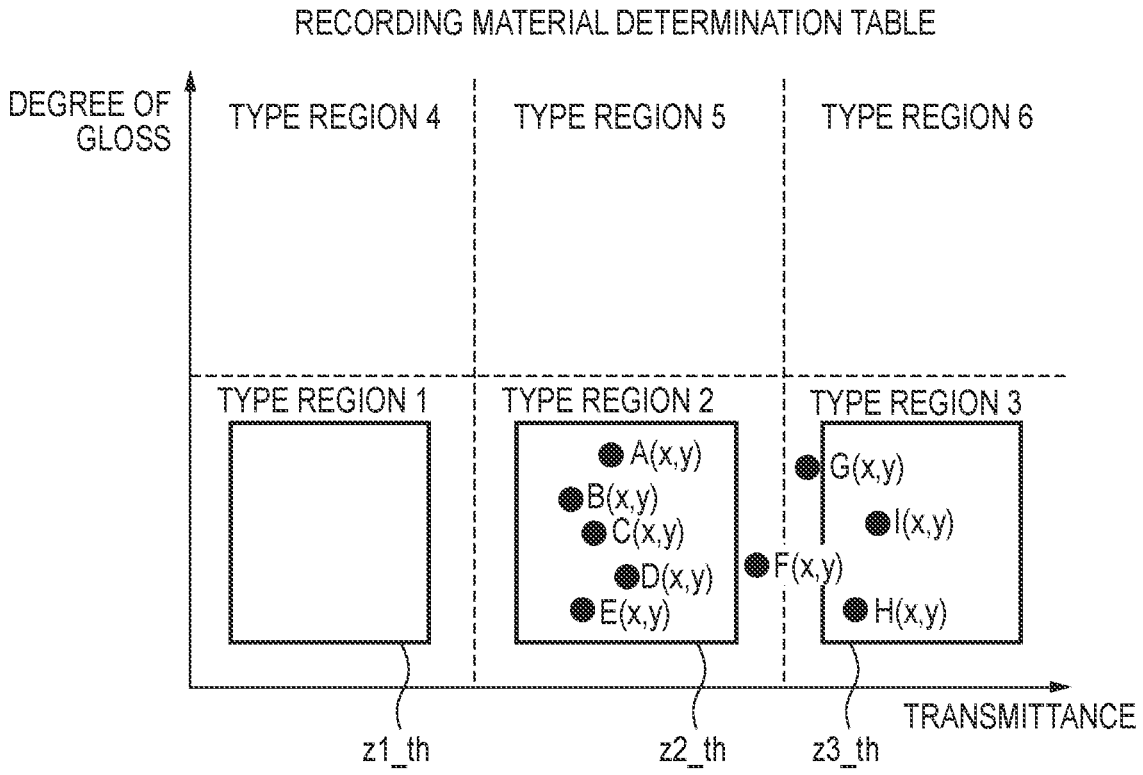
FIG. 7 is a view illustrating a recording material determination (Example 1) according to the first embodiment.

As illustrated in FIG. 7, a transmittance and a degree of gloss, which are output of the recording material determination control unit 411 from the image forming apparatus 100A, are defined as A(x, y). Similarly, output corresponding to each of the image forming apparatus 100B-100E is defined as B(x, y), C(x, y), D(x, y), and E(x, y) respectively. Furthermore, output from an image forming apparatus 100F and the like (not shown) is defined as F(x, y), G(x, y), H(x, y), and I(x, y). Also, region thresholds (hereinafter referred to as a type region threshold) by which a region is made to be narrower by a predetermined ratio in relation to boundaries between respective type regions are set for each type region, and defined as $z1_{_th}$, $z2_{_th}$, and $z3_{_th}$. These thresholds may be absolute values of a distance from the boundary, or relative values.

Figure 8:
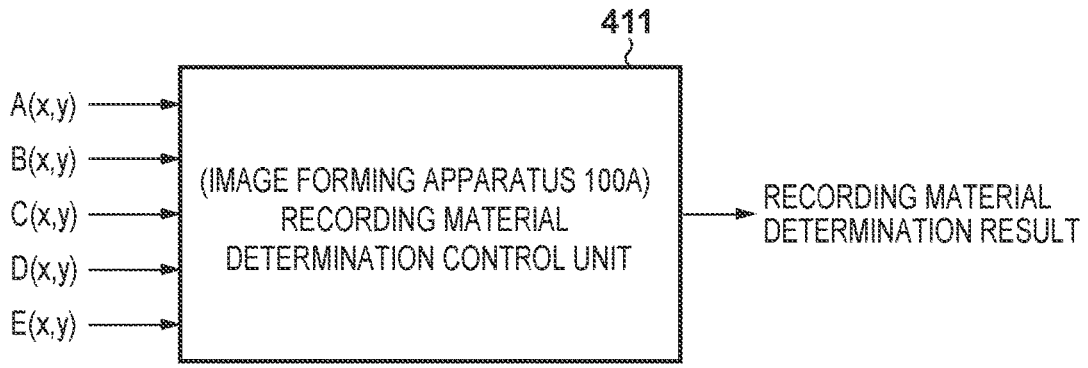
FIG. 8 is a view for illustrating a recording material determination confirmation method in the recording material determination (Example 1) according to the first embodiment.

Here, a method of obtaining the result of determination of the recording material of the image forming apparatus 100A is described using FIG. 7 as an example. Firstly, at a timing at which A(x, y) which is detected with a first sheet of the image forming apparatus 100A is obtained, the results of recording material determination of other image forming apparatuses 100 falling within the same type region are obtained via the network 150. Here, to improve determination accuracy, the type of recording material is determined from the recording material determination results of 5 devices, including the image forming apparatus 100A. Note that obtained recording material determination results are more than 5, but the useful results among these are extracted. In other words, a predetermined threshold in relation to the number of useful recording material determination results is made to be 5. For example, as with F(x, y), a recording material determination result positioned outside of the threshold, even if included in the same type region (type region 2 here), is not used in the recording material determination for the image forming apparatus 100A. The reason for not using such results is consideration for error in the recording material determination sensor and characteristic variation in recording materials, and since it is not possible to exclude the possibility that it is data that should be included in another type region (for example, type region 3) due to the error. In the example of FIG. 7, if it is possible to obtain B(x, y), C(x, y), D(x, y), and E(x, y), which are included in the same type region, in addition to A(x, y), as in FIG. 8, it is possible to confirm the recording material determination result (as type region 2 here) in the image forming apparatus 100A.

Figure 9:
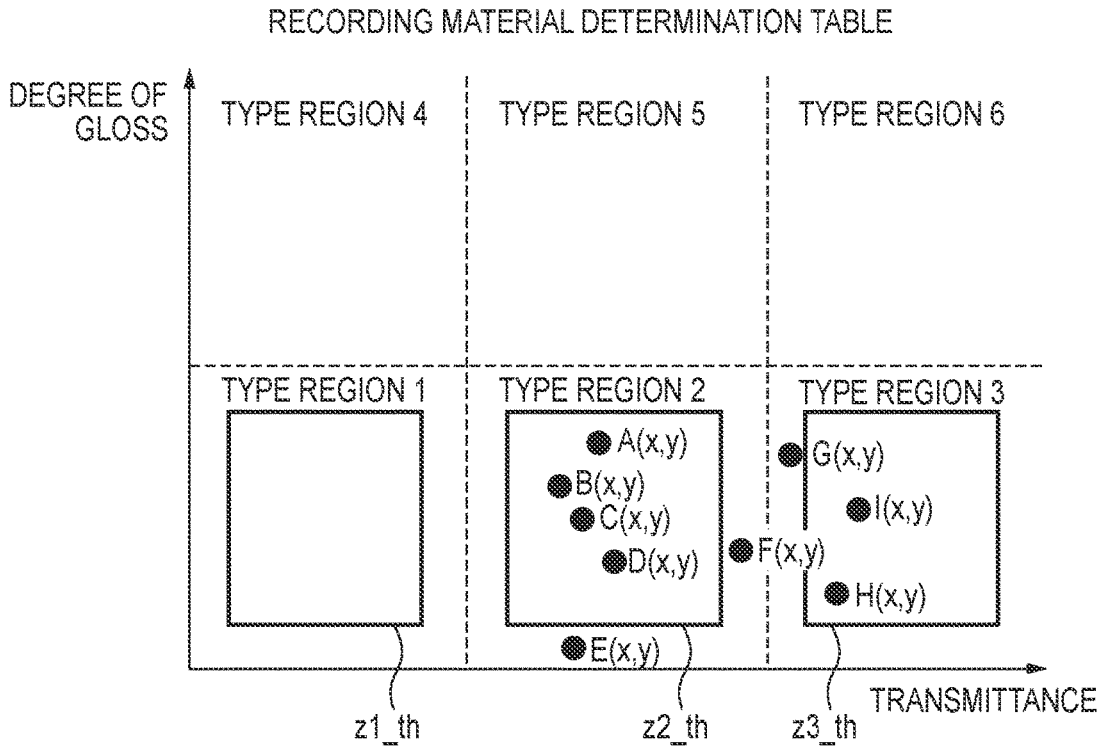
FIG. 9 is a view illustrating a recording material determination (Example 2) according to the first embodiment.

As another example, a method of obtaining the result of determination of the recording material of the image forming apparatus 100A is described using FIG. 9. Similarly to in the previous example, the recording material is determined from the recording material determination results of 5 devices, including the image forming apparatus 100A. In other words, the threshold corresponding to the number of useful recording material determination results is made to be 5. In the case of the example of FIG. 9, there are only three image forming apparatuses other than the image forming apparatus 100A that are included in the type region threshold of type region 2 (the image forming apparatus 100B-100D). In such a case, the image forming apparatus 100A further obtains A2(*x, y*) which is the recording material determination result corresponding to a second recording material (a time of a second image formation).

Figure 10:
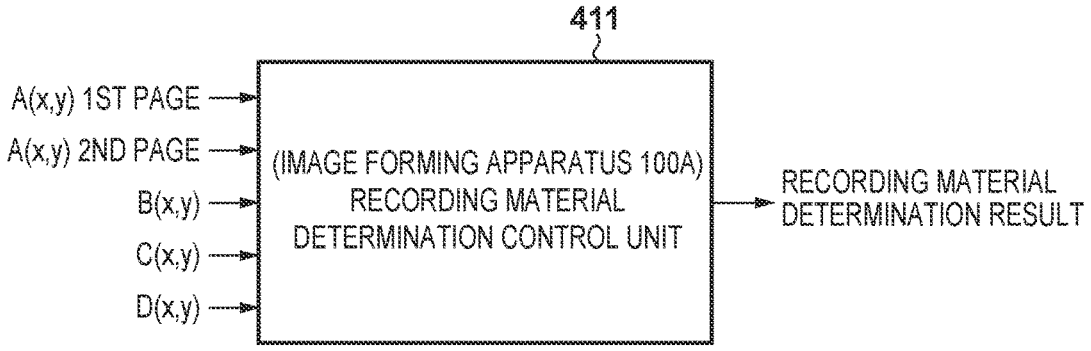
FIG. 10 is a view for illustrating a recording material determination confirmation method in the recording material determination (Example 2) according to the first embodiment.

By this, the image forming apparatus 100A collects five recording material determination results. The result of this is that the threshold corresponding to the number of useful recording material determination results is satisfied. Then, as illustrated in FIG. 10, the determination result is confirmed by using these recording material determination results. Note that a demerit here is that the productivity decreases in the first sheet and second sheet image forming operations. Specifically, because it is necessary to perform the recording material detection operation at the time of the image forming operation corresponding to the second recording material, the image forming processing is delayed by that amount. However, the load is suppressed compared to a configuration in which the recording material determination result cannot be confirmed until results numbering a predetermined threshold (in the foregoing example, the threshold is 5) are obtained in the same image forming apparatus as is conventional, and it is possible to confirm the recording material more quickly.

[Process Flow]

Figure 11:
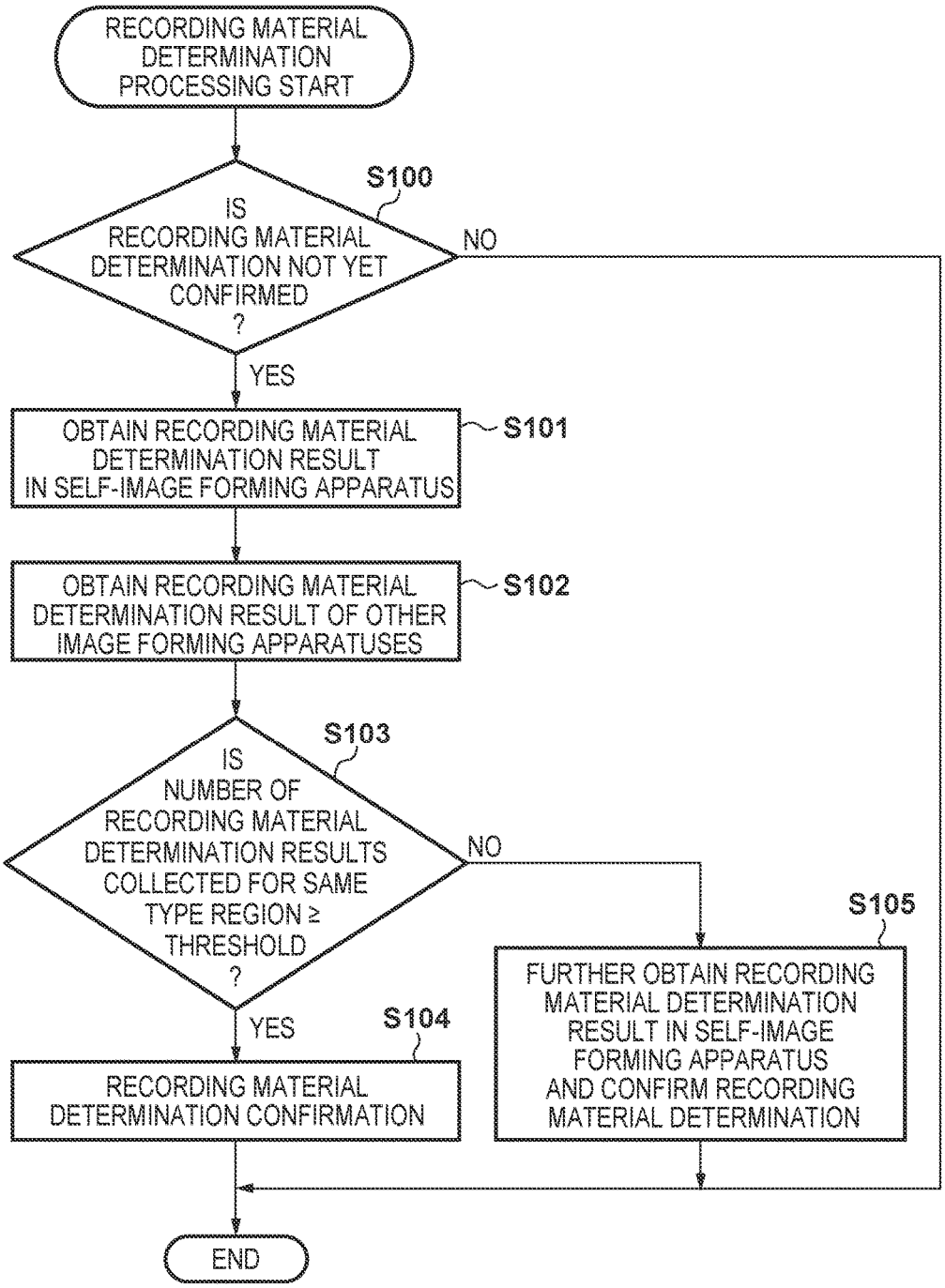
FIG. 11 is a flowchart for recording material determination processing according to the first embodiment.

Using FIG. 11, a flowchart for recording material determination processing in the image forming apparatus 100A is described with the example of FIG. 9. Note that each step of this processing flow is realized by the recording material determination control unit 411. This processing flow is performed when an image forming apparatus 100 is activated or restarted or when new recording material is inserted, for example.

In step S100, the recording material determination control unit 411, when a leading edge of the first recording material reaches the recording material determination sensor 200, first confirms whether or not the determination of the recording material stored in the feeding unit 530 of the image forming apparatus 100A is already confirmed. In the case where it is not yet confirmed (YES in step S100), the processing advances to step S101, and in the case where it has been confirmed (NO in step S100), this processing flow ends.

In step S101, the recording material determination control unit 411 obtains the recording material determination result A1(*x, y*) in the image forming apparatus 100A. Here, in the case of the foregoing example, recording material stored in the feeding unit 530 of the image forming apparatus 100A is specified as being included in type region 2.

In step S102, the recording material determination control unit 411, via the network 150, obtains the recording material determination results of the other image forming apparatuses 100. As described above, the recording material determination results in this step may be obtained collectively via a server, or may be obtained directly from the other image forming apparatuses. Also, in the case of directly obtaining the results from the other image forming apparatuses, in the case where there is an image forming apparatus in a state in which it cannot be communicated with, obtainment from that image forming apparatus may be omitted.

In step S103, the recording material determination control unit 411 determines whether or not the number of recording material determination results in the same type region is greater than or equal to the predetermined threshold. The predetermined threshold here is 5 in the case of the foregoing example. Also, as described above, recording material determination results outside of a type region threshold are not used. Specifically, because the recording material determination results obtained considering the type region threshold z2_*th* are B(x, y), C(x, y), and D(x, y) only, four recording material determination results are included in type region 2, which is lower than the threshold. In the case where the number of the recording material determination results that can be obtained is greater than or equal to the predetermined threshold (YES in step S103), the processing advances step S104, and in the case where the number that can be obtained is less than the threshold (NO in step S103), the processing advances to step S105.

In step S104, the recording material determination control unit 411 confirms the recording material determination. For example, in the case where it is possible to collect five or more recording material determination results included in type region 2, the recording material in the image forming apparatus 100A is determined to be "normal paper" which corresponds to type region 2 as illustrated in FIG. 6B, and this is confirmed. This processing flow is then terminated.

In step S105, the recording material determination control unit 411 obtains A2(*x, y*) which is the recording material determination result of the image forming apparatus 100A corresponding to a second recording material in the image forming apparatus 100A. Then, the recording material determination control unit 411 determines the recording material based on five recording material determination results including A2(*x, y*), and as a result, the recording material determination is confirmed. Note that until image formation is performed in relation to the second recording material (or, until the recording material is conveyed to the position of the recording material determination sensor 200), the determination of the recording material is not confirmed. Also, in the case where the number of recording material determination results does not reach the threshold even including the recording material determination results corresponding to the second recording material, the recording material determination results corresponding to the next recording material are then obtained. This processing flow is then terminated.

By the present embodiment, it becomes possible to confirm a recording material determination while reducing a decrease of productivity of an image forming apparatus when executing a recording material determination.

Note that in the present embodiment, it is assumed in the description that the image forming apparatuses are arranged on the same floor, but limitation is not made to this assumption if the image forming apparatuses use the same type of recording material. Also, configuration may be taken such that each image forming apparatus confirms a communication state with the other image forming apparatuses or a server, and if communication is not possible or the communication load is high, recording material determination is performed based on the detection results of the sensor of the apparatus itself in place of obtaining information from an external unit. Accordingly, even in the case where recording material determination results of the other image forming apparatuses cannot be obtained, it is possible to confirm a recording material determination by the apparatus itself performing detection a number of times proportional to the predetermined threshold, and it is possible to maintain robustness thereby.

Note that in the foregoing example, the image forming apparatus specifies a type of recording material using the results it detected itself as a reference, but limitation is not made to this. For example, configuration may be taken such that the server confirms the type of recording material of the image forming apparatus 100A using the detection results collected from other image forming apparatuses while making the result that the image forming apparatus 100A detected a reference.

<Second Embodiment>

In the second embodiment is described a configuration in which, in addition to the determination of the recording material, determination of a fixing temperature is made possible. Also, a configuration is taken such that in the determination of the fixing temperature, a recording material determination is continued even when one of a transmittance sensor for determining the transmittance of a recording material and a degree of gloss sensor for determining a degree of gloss of the recording material determination sensor 200, which is installed in the image forming apparatus 100, malfunctions. Note that description is omitted for portions that overlap the configuration described in the first embodiment.

[Recording Material Determination Control Unit Determination Function]

The recording material determination control unit 411 according to the second embodiment, similarly to in the first embodiment, detects the transmittance and degree of gloss of a recording material, and the type region is specified by plotting these as coordinates in a recording material determination table, as illustrated in FIG. 6A. In the example here, description assumes that, similarly to in the first embodiment, type region 2 is specified.

Figures 12A, 12B:
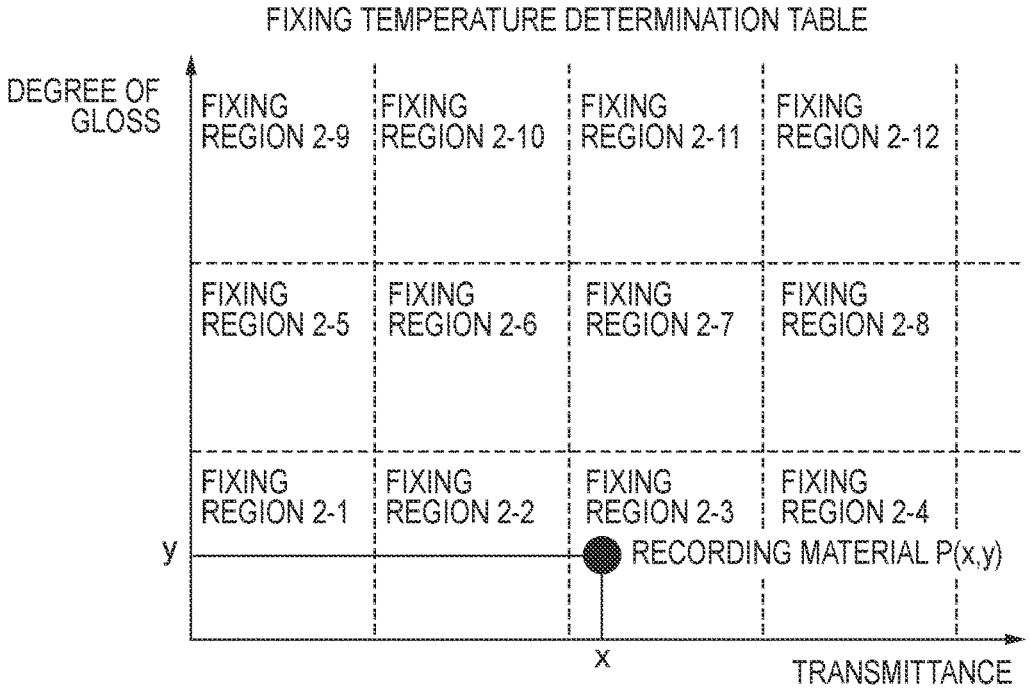
FIGS. 12A and 12B are views for describing a recording material determination table according to a second embodiment.
Figure 13:
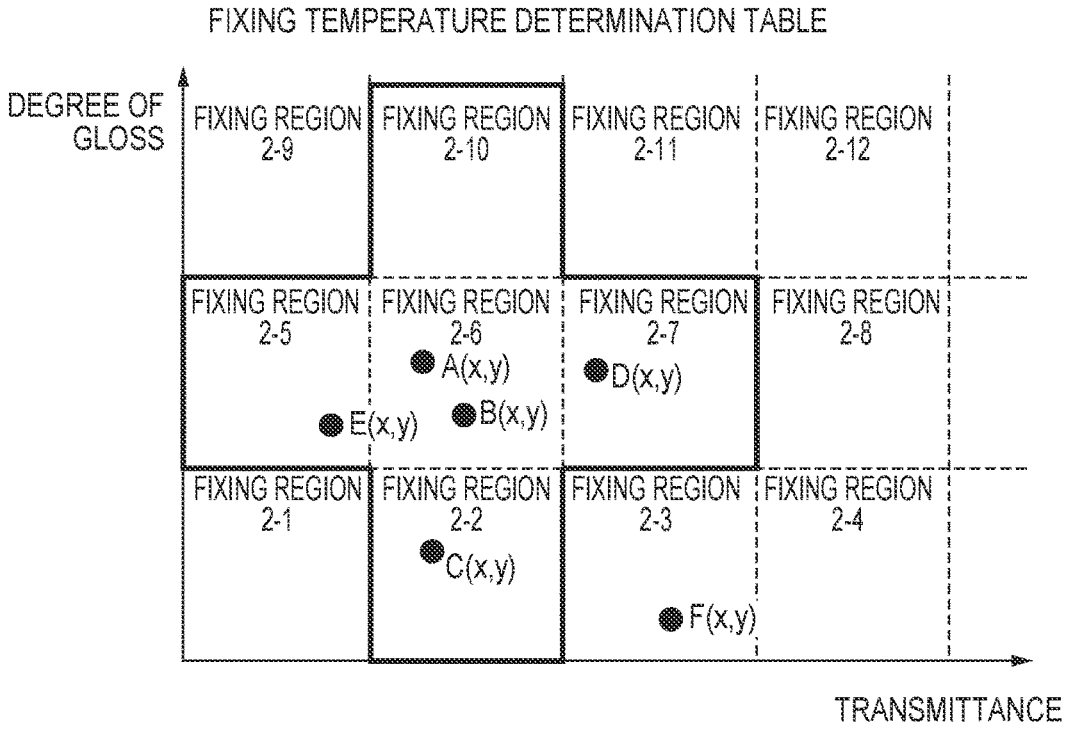
FIG. 13 is a view illustrating a recording material determination (Example 1) according to the second embodiment.

In the second embodiment, the type regions are further divided as fixing regions, and a fixing temperature necessary for the recording material is calculated. Specifically, as illustrated in FIG. 12A, the type regions are further divided, and an appropriate fixing temperature is calculated from the coordinates (x, y) that the transmittance and the degree of gloss of the recording material indicate. FIGS. 12A and 12B illustrate a portion of type region 2 out of the coordinates illustrated in FIGS. 6A and 6B. The actual fixing temperature is decided using the fixing temperature table illustrated in FIG. 12B. FIGS. 12A and 12B and FIG. 13, similarly to FIGS. 6A and 6B, both illustrate the abscissa (x-axis) as the transmittance and the ordinate (y-axis) as the degree of gloss. In the case of the example of FIG. 12A, type region 2 is divided into 12 fixing regions. Note that the size and number of fixing regions may vary in accordance with the type of recording material corresponding to the type region.

Furthermore, similarly to in the first embodiment, when A(x, y) which is detected from the first recording material of the image forming apparatus 100A is obtained, the fixing temperatures of the other image forming apparatuses 100 are obtained via the network 150. However, considering recording material determination sensor error and characteristic variation in recording materials, only detection results included in ±1° C. in relation to the fixing temperature region detected in the image forming apparatus 100A are obtained, and the fixing temperature is confirmed using compatible detection results. Using the example of FIG. 13, the fixing region included in ±1° C. in relation to A(x, y) is within the thick frame. Then, the detection results that are compatible with this condition are B(x, y), C(x, y), D(x, y), and E(x, y).

Figure 14:
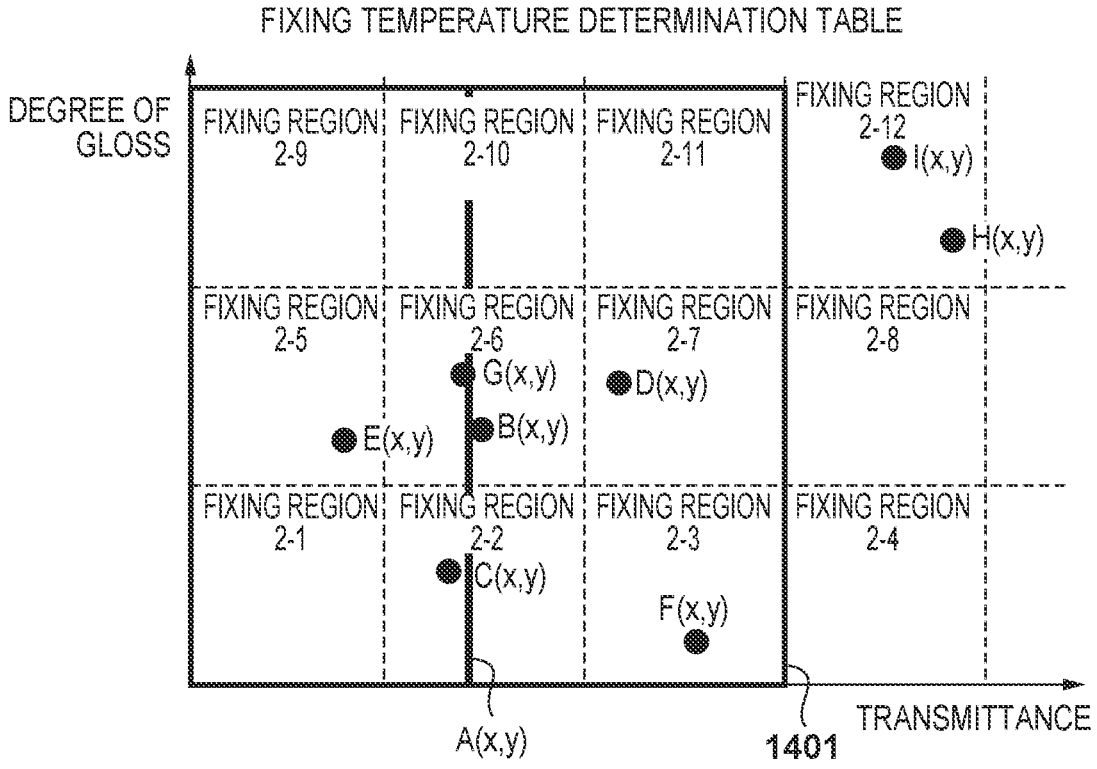
FIG. 14 is a view illustrating a recording material determination (Example 2) according to the second embodiment.

Here, assume that the degree of gloss sensor is malfunctioning in the recording material determination control unit 411 of the image forming apparatus 100A. In the case that the degree of gloss sensor is malfunctioning, a degree of gloss y in relation to A(x, y) is indefinite, and therefore as illustrated in FIG. 14, A(x, y) is a thick vertical line portion. By calculating the degree of gloss of the image forming apparatus 100A by processing for averaging samples included in the thick frame 1401 which indicates fixing regions whose transmittance values are on the left and right in relation to A(x, y), it becomes possible to presume the fixing temperature of the image forming apparatus 100A. Though not illustrated, detection results that are of different type regions (in this case those that are not type region 2) are of course excluded even if included in this temperature threshold (frame 1401).

In the example of FIG. 14, it is possible to obtain the fixing temperature needed for the recording material mounted in the image forming apparatus 100A by B(x, y), C(x, y), D(x, y), E(x, y), G(x, y), and F(x, y).

Note that as an example, in FIG. 14, five useful detection results are envisioned. In reality, it is ideal that the fixing temperature of the image forming apparatus 100A be obtained by as many detection results included in the ±1° C. threshold as possible. Also, similar processing can be used when the sensor that is malfunctioning is a transmittance sensor rather than a degree of gloss sensor.

[Process Flow]

Figure 15:
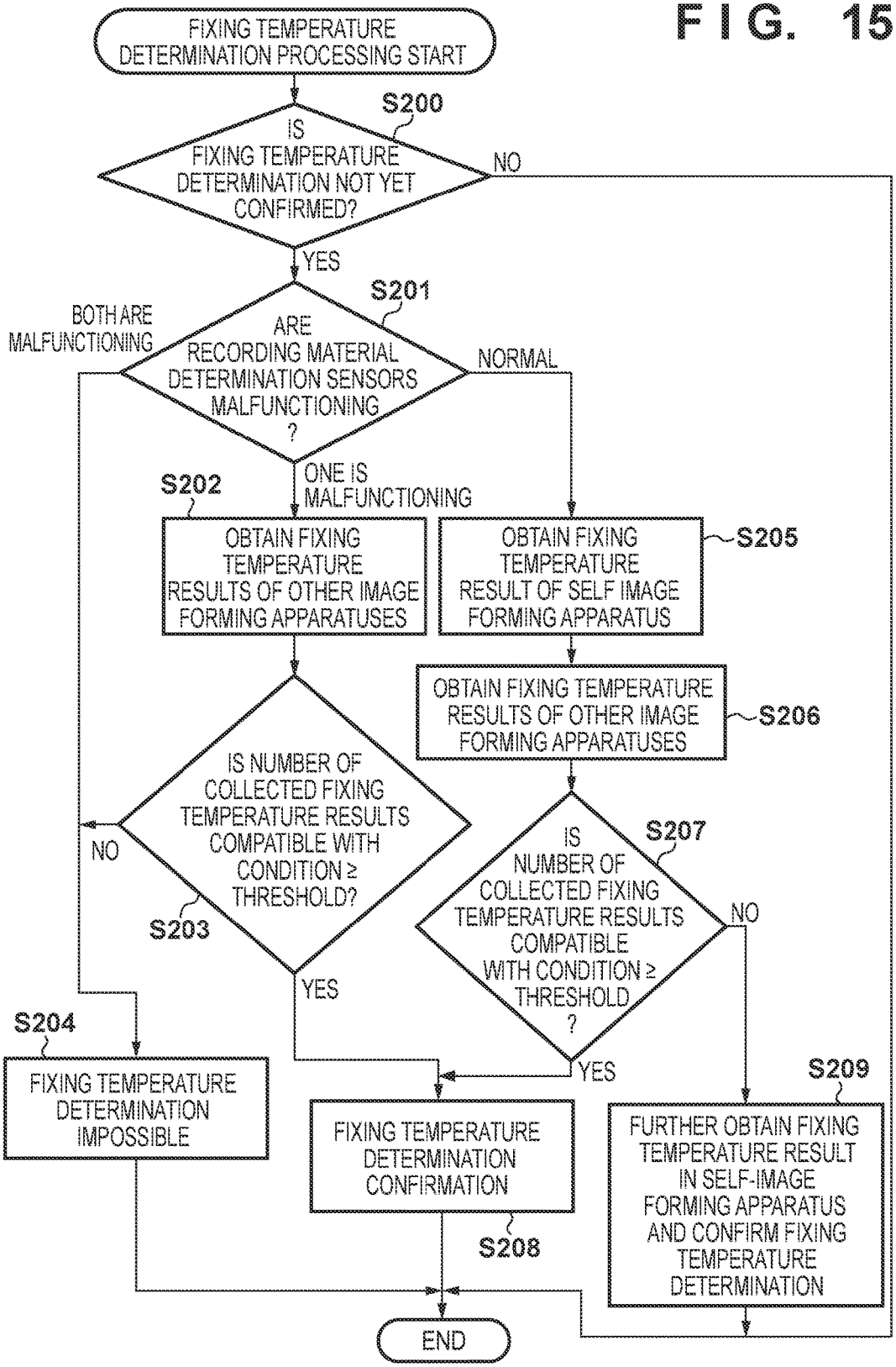
FIG. 15 is a flowchart for recording material determination processing according to the second embodiment.

A flowchart for fixing temperature determination processing in the image forming apparatus 100A is described in FIG. 15. Note that each step of this processing flow is realized by the recording material determination control unit 411. Note that this processing may be performed in parallel to the processing of FIG. 11 described in the first embodiment, and may be executed after the processing of FIG. 11.

In step S200, the recording material determination control unit 411, when the leading edge of a first recording material reaches the recording material determination sensor 200, first confirms whether or not the recording material fixing temperature determination has already been confirmed. In the case where it is not yet confirmed (YES in step S200), the processing advances to step S201, and in the case where it has been confirmed (NO in step S200), this processing flow ends.

In step S201, the recording material determination control unit 411 confirms whether the transmittance sensor and the degree of gloss sensor of the recording material determination sensor 200 mounted in the image forming apparatus 100A are in a state of malfunction. If both are malfunctioning, the processing advances to step S204, and if only one of them is malfunctioning, the processing advances to step S202. Also, if both are normal, the processing advances to step S205.

In step S202, the recording material determination control unit 411, via the network 150, obtains the fixing temperature determination results of the other image forming apparatuses 100. Specifically, a detection result compatible with the condition is obtained by the method described in FIG. 14.

In step S203, the recording material determination control unit 411 determines whether or not it was possible to obtain a number of fixing temperature determination results greater than or equal to a predetermined threshold. Here, the predetermined threshold is 5. In the case where the number of fixing temperature determination results that can be obtained is greater than or equal to the predetermined threshold (YES in step S203), the processing advances step S208, and in the case where the number that can be obtained is less than the threshold (NO in step S203), the processing advances to step S204.

In step S204, the recording material determination control unit 411 determines that the fixing temperature determination cannot be made. Next, this processing flow is terminated.

In step S205, the recording material determination control unit 411 obtains a first fixing temperature determination result A1(*x, y*) in the image forming apparatus 100A, and specifies a fixing region of the recording material in the image forming apparatus 100A. Note that configuration may be taken such that, in the case where the processing of FIG. 11 completes and the recording material determination is confirmed, information of the confirmed recording material type is obtained instead of obtaining the fixing temperature determination result.

In step S206, the recording material determination control unit 411, via the network 150, obtains the fixing temperature determination results of the other image forming apparatuses 100.

In step S207, the recording material determination control unit 411 determines whether or not it is possible to obtain a number of fixing temperature determination results in other image forming apparatuses 100 included in the ±1° C. threshold in relation to the fixing temperature that A(x, y) which is specified in step S205 indicates that is greater than or equal to the predetermined threshold. Here, the predetermined threshold is 5. In the case where the number of fixing temperature determination results that can be obtained is greater than or equal to 5 including A(x, y) (YES in step S207), the processing advances step S208, and in the case where the number that can be obtained is less than the threshold (NO in step S207), the processing advances to step S209.

In step S208, the recording material determination control unit 411, based on the fixing temperature determination result that was obtained, confirms the fixing temperature determination in the image forming apparatus 100A. This processing flow is then terminated.

In step S209, the recording material determination control unit 411 obtains the fixing temperature determination result A2(*x, y*) corresponding to the second recording material in the image forming apparatus 100A. Then, the recording material determination control unit 411 determines the fixing temperature based on the detection results including A2(*x, y*), and as a result, the determination of the fixing temperature in the image forming apparatus 100A is confirmed. This processing flow is then terminated.

By the present embodiment, in addition to the effect of the first embodiment, it is possible to determine the fixing temperature of image formation with respect to a recording material. Here, even in a case where a malfunction is occurring in a part of the recording material determination control unit 411, it is possible to determine the fixing temperature.

<Other Embodiments>

Figure 16:
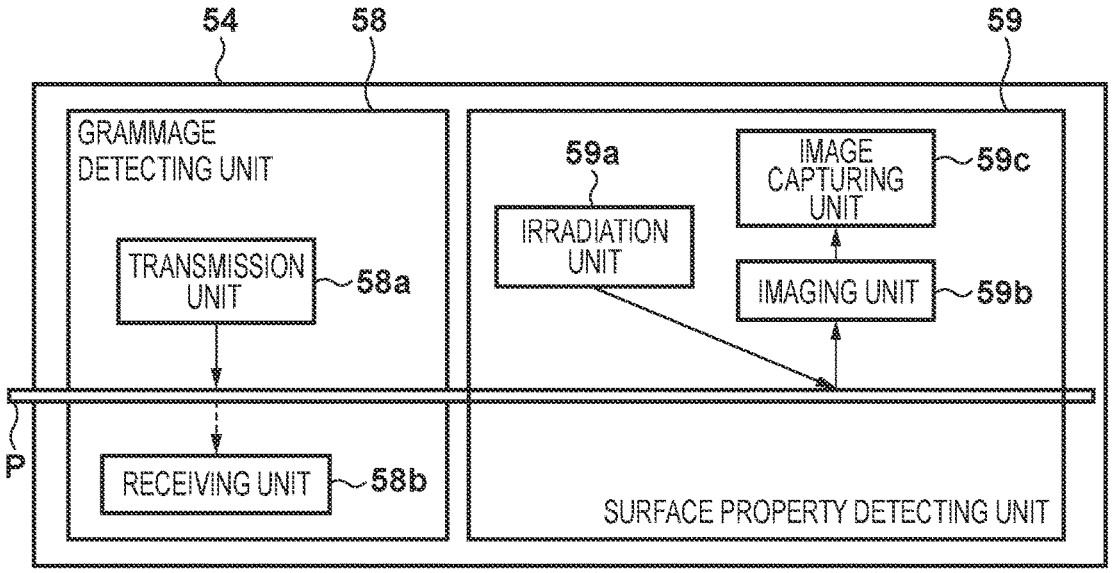
FIG. 16 is a view illustrating an example of another configuration of a recording material determination sensor according to the present invention.

In the foregoing embodiments, a recording material determination sensor 200 of a type that detects reflected light and transmitted light as characteristics of a recording material was described, but limitation is not made to this. For example, a recording material determination sensor 54 comprising a grammage detecting unit 58 and a surface property detecting unit 59, as illustrated in FIG. 16 may be used. In such a case, a configuration in which a grammage and a surface property (unevenness) are detected as recording material characteristics is assumed. Here, it is assumed that the results of detection by the grammage detecting unit 58 and the surface property detecting unit 59 are sent to the signal processing unit 307 in FIG. 5.

The grammage detecting unit 58 transmits ultrasonic waves from a transmission unit 58*a*, and, via the recording material P, receives attenuated ultrasonic waves by a receiving unit 58*b*. Then, the signal processing unit 307 obtains the grammage of the recording material P based on an amplitude value of the ultrasonic waves that the receiving unit 58*b* received.

The surface property detecting unit 59 is configured by an irradiation unit 59*a*, an imaging unit 59*b*, and an image capturing unit 59*c*. The irradiation unit 59*a* irradiates light onto a recording material P, and the imaging unit 59*b* images the light reflected by the surface of the recording material P. The image capturing unit 59*c* is a light receiving unit for receiving the light imaged by the imaging unit 59*b*, and the received light is captured as a surface image of the recording material P. Then, based on the surface image that the image capturing unit 59*c* captured, the signal processing unit 307 obtains the surface property (unevenness) of the recording material P. Then, based on the obtained grammage and surface property, a main control unit 306 performs a determination of the recording material P. The main control unit 306, in advance, holds a table indicating characteristic information (ranges) recording materials corresponding to the signals (values related to the grammage and the surface property) obtained by the grammage detecting unit 58 and the surface property detecting unit 59, and is able to determine the type of the recording material by comparing this information with the detection result.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-230563, filed Nov. 28, 2016, which is hereby incorporated by reference herein in its entirety.

What is claimed is:

1. An image forming apparatus connectable to at least another image forming apparatus, the image forming apparatus comprising:

a detecting sensor configured to detect a characteristic of a recording material; and a processor configured to:

obtain detection results from the detecting sensors of both the image forming apparatus and the at least another image forming apparatus connected therewith;

in a case where a total number of the detection results obtained from the detecting sensors is less than a predetermined threshold, cause the detecting sensor in the image forming apparatus to further execute a detection operation; and in a case where the total number of detection results reaches the predetermined threshold, determine a type of the recording material used for image formation in the image forming apparatus based on the detection results from the detecting sensors.

2. The image forming apparatus according to claim 1, wherein the characteristic of the recording material includes a degree of gloss and a transmittance of the recording material.

3. The image forming apparatus according to claim 2, further comprising:

a storage device storing a table indicating, in relation to each of a plurality of types of recording materials, a range of a transmittance and a degree of gloss, wherein the processor, using the table, specifies a type of the recording material corresponding to the detection results.

4. The image forming apparatus according to claim 1, wherein the detecting sensor includes a first light source and a second light source that irradiate light onto the recording material, a first light detector that receives the light irradiated from the first light source and reflected by a surface of the recording material, and a second light detector that receives the light irradiated from the second light source and transmitted through the recording material.

5. The image forming apparatus according to claim 1, wherein the characteristic of the recording material includes a grammage and a surface property of the recording material.

6. The image forming apparatus according to claim 5, further comprising:

a storage device storing a table indicating, in relation to each of a plurality of types of recording materials, a range of values related to a grammage and a surface property, wherein the processor, using the table, specifies a type of the recording material corresponding to the detection results.

7. The image forming apparatus according to claim 1, wherein the detecting sensor includes a transmitting unit configured to transmit an ultrasonic wave towards a recording material, a receiving unit configured to receive the ultrasonic wave transmitted from the transmitting unit and attenuated via the recording material, a light source that irradiates light onto a recording material, and a light sensor that receives the light irradiated from the light source and reflected by a surface of the recording material.

8. The image forming apparatus according to claim 6, wherein:

the processor extracts detection results indicating a value corresponding to a type of the recording material specified thereby, which is indicated in the table based on the detection results obtained from the detecting sensors, and the processor, in a case where the number of extracted detection results is greater than or equal to the predetermined threshold, decides the type of the recording material to be used in the image formation.

9. The image forming apparatus according to claim 8, wherein the processor performs a detection of a recording material upon image formation of a first sheet after a recording material is replenished.

10. The image forming apparatus according to claim 8, wherein:

in a case where the number of extracted detection results is less than the predetermined threshold, the processor performs a recording material detection, and the processor decides the type of the recording material by including the further performed detection result.

11. The image forming apparatus according to claim 1, wherein the processor further decides a fixing temperature corresponding to the determined recording material, based on the detection results obtained from the detecting sensors.

12. The image forming apparatus according to claim 11, wherein:

the detecting sensor comprises a first sensor configured to detect a first characteristic of the recording material, and a second sensor configured to detect a second characteristic different to the first characteristic of the recording material, and the processor, in a case where at least one of the first sensor or the second sensor is normally operating, decides the fixing temperature based on the detection results obtained from the detecting sensors.

13. The image forming apparatus according to claim 1, wherein the processor obtains the detection results from the at least another image forming apparatus installed on the same floor.

14. A system comprising:

a first image forming apparatus;

a second image forming apparatus; and a server that collects detection results from image forming apparatuses, wherein each of the first and second image forming apparatuses includes a detecting sensor configured to detect a characteristic of a recording material, and wherein the first image forming apparatus includes a processor configured to:

obtain detection results from the detecting sensors of both the first and second image forming apparatuses;

in a case where a total number of detection results obtained from the detecting sensors is less than a predetermined threshold, cause the detecting sensor in the first image forming apparatus to further execute a detection operation; and in case where the total number of detection results reaches the predetermined threshold, determine a type of the recording material used for image formation in the first image forming apparatus based on the detection result from the detecting sensors.

* * * * *